US005338605A

United States Patent [19]

Noland et al.

[11] Patent Number: 5,338,605

[45] Date of Patent: Aug. 16, 1994

[54] HOLLOW CARBON FIBERS

[75] Inventors: Robert L. Noland, Carson City, Nev.; Timothy D. O'Brien, Crofton, Md.

[73] Assignee: Ketema, Inc., Odenton, Md.

[21] Appl. No.: 688,410

[22] Filed: Apr. 22, 1991

Related U.S. Application Data

[63] Continuation-in-part of Ser. No. 476,050, Jan. 31, 1990, Pat. No. 5,298,313, and a continuation-in-part of Ser. No. 534,075, Jun. 6, 1990.

[51] Int. Cl.[5] ..... D02G 3/00

[52] U.S. Cl. ..... 428/398; 428/367; 524/495; 524/505; 524/566; 524/602

[58] Field of Search ..... 428/398, 367; 210/500.23; 264/29.2; 524/495, 602, 565, 566

[56] References Cited

U.S. PATENT DOCUMENTS

| | | | |
|---|---|---|---|
| 3,242,411 | 12/1980 | Costa, Jr. et al. | 428/369 |
| 3,871,950 | 3/1975 | Hashino et al. | 161/178 |
| 3,884,754 | 5/1975 | Kimura et al. | 428/398 |
| 3,887,747 | 6/1975 | Tamura et al. | 428/229 |
| 3,949,115 | 4/1976 | Tamura et al. | 428/367 |
| 4,130,689 | 12/1978 | Costa,Jr. | 428/398 |
| 4,175,153 | 11/1979 | Dobo et al. | 428/398 |
| 4,329,157 | 5/1982 | Dobo et al. | 55/16 |
| 4,374,114 | 2/1983 | Kim et al. | 423/447.1 |
| 4,385,017 | 5/1983 | Joh et al. | 264/41 |
| 4,402,928 | 9/1983 | Lewis et al. | 423/447.1 |
| 4,442,165 | 4/1984 | Gebhardt et al. | 428/307.7 |
| 4,460,641 | 7/1984 | Barer et al. | 428/246 |
| 4,535,028 | 8/1985 | Yokogi et al. | 428/398 |
| 4,651,649 | 3/1987 | Nussbaum | 102/521 |
| 4,670,341 | 6/1987 | Lundsager | 428/372 |
| 4,685,940 | 8/1987 | Soffer et al. | 55/158 |
| 4,689,267 | 8/1987 | Takamizawa et al. | 428/376 |
| 4,699,896 | 10/1987 | Sing et al. | 502/423 |
| 4,708,800 | 11/1987 | Ichikawa et al. | 210/500.23 |
| 4,735,841 | 4/1988 | Sourdet | 428/116 |
| 4,746,470 | 5/1988 | Fujimaki et al. | 264/29.2 |
| 4,847,063 | 7/1989 | Smith | 423/445 |
| 4,857,081 | 8/1989 | Taylor | 55/16 |
| 4,882,223 | 11/1989 | Aptel et al. | 428/398 |
| 4,900,626 | 2/1990 | Fabre | 428/398 |
| 4,933,084 | 6/1990 | Bandel et al. | 210/500.23 |
| 4,992,332 | 2/1991 | Kamei et al. | 428/398 |
| 4,992,485 | 2/1991 | Koo et al. | 521/180 |
| 5,011,566 | 4/1991 | Hoffman | 156/643 |
| 5,089,135 | 2/1992 | Yoneyama et al. | 210/500.23 |

FOREIGN PATENT DOCUMENTS

| | | |
|---|---|---|
| 61-083321 | 4/1986 | Japan . |
| 3098622 | 4/1991 | Japan . |
| 729211 | 4/1980 | U.S.S.R. . |

OTHER PUBLICATIONS

Jain, M. et al. Oxidative Stabilization of Oriented Acrylic Fibers–Morphological Rearrangements, J. of Mat. Sci. 18(1983), pp. 179–188.

Grove, D. et al. Exploratory Experiment in the Conversion of Plasticized Melt Spun Pan–Based Precursors to Carbon Fibers. vol. 26, pp. 403–411, 1988.

Balasubramanian, M. et al. Evolution of Structure and Properties in Continuous Carbon Fiber Formation, pp. 312–313.

Jain, M. K., et al., Morphology and Oxidative Stabilization of Acrylic Precursor Fibers, pp. 310–311.

Jain, M. K., et al., Morphological Rearrangement of Acrylic Fibers to Carbon Fibers: Oxidative Stabilization. pp. 517–518.

Balasubramanian, M., et al., High–Temperature Deformations in Conversion of Acrylic Fibers to Carbon Fibers. pp. 497–498.

D. D. Edie and C. Fain, Materials and Processing Report, May 1986, p. 3.

M. G. Harrison, C. C. Fain and D. D. Edie, Study of Hollow and C–Shaped Pitch–Based Carbon Fibers, pp. 77–83.

D. D. Edie, N. K. Fox, B. C. Barnett and C. C. Fain, Melt–Spun Non–Circular Carbon Fibers, Carbon, vol. 24, No. 4, pp. 477–482, 1986.

*Primary Examiner*—Donald P. Walsh
*Assistant Examiner*—Ngoclan T. Mai
*Attorney, Agent, or Firm*—Sheridan Neimark

[57] ABSTRACT

Hollow carbon and graphite filaments having a specific gravity of about 20–50% less than conventional solid carbon fibers made of the same precursor resin are formed by spinning hollow precursor resin filaments. These low density hollow carbon filaments have improved insulating properties compared with conventional solid carbon fibers and have an excellent bending strength to weight ratio.

19 Claims, 1 Drawing Sheet

HOLLOW CARBON FIBERS

RELATED APPLICATION

This is a continuation-in-part of co-pending applications Ser. No. 07/476,050 filed Jan. 31, 1990, U.S. Pat. No. 5,298,313 and Ser. No. 07/534,075 filed Jun. 6, 1990 pending, the contents of both of which are hereby incorporated by reference.

FIELD OF INVENTION

The present invention relates to improved carbon fibers of reduced weight, and products using such reduced weight carbon fibers. The term "carbon fibers" is intended to include graphite fibers.

BACKGROUND

Carbon fibers are made from a number of precursor materials including primarily viscose rayon (regenerated cellulose), polyacrylonitrile (PAN) and pitch, and sometimes other precursor resins as well, attention being particularly invited to the background portion of co-pending application Ser. No. 07/534,075. A recent patent (U.S. Pat. No. 4,921,656) discloses the formation of a melt spun PAN precursor for carbon fibers.

Conventional carbon fibers are used in thermal insulation environments to replace asbestos for many purposes, such as furnace insulation, brakes including aircraft, automotive, truck, and off-road vehicle brakes, passive fire protection, etc. In brakes, carbon fibers are used in a carbon matrix to provide a carbon-carbon structure.

Concerning carbon-carbon materials, the Kirk-Othmer Encyclopedia of Chemical Technology (3rd Ed. 1980), Vol. 12, page 463 states:

> Carbon represents the ultimate high temperature end-member of polymer matrix materials. It has one of the highest temperature capabilities under non-oxidizing conditions among known materials (it melts or sublimes, depending on the pressure, at 3550° C.). Additional considerations of chemical and thermal compatibility make it natural to use carbon and graphite fibers as the reinforcement material. The resultant carbon-carbon . . . composites . . . are especially desirable where extreme temperatures may be encountered, such as in rocket nozzles, ablative materials for re-entry vehicles and disk brakes for aircraft. Other uses include bearing materials . . . and hot-press die components.

The specific gravity of carbon fibers depends on a number of factors including the nature of the precursor material and the degree of crystallinity (if any) in the resultant carbon fiber. Thus, well-ordered graphite molecular structure is dense. Novoloid precursor based carbon fibers are amorphous and have a relatively low specific gravity, whereas carbon fibers based on PAN are much denser having a normal specific gravity ($g/cm^3$) of 1.8–2.0. The Kirk-Othmer Encyclopedia of Chemical Technology (3rd Ed 1981), Vol 16, page 135 contains a table (Table 3) showing typical properties of carbon fibers.

The most commonly used PAN based carbon filaments have a specific gravity of 1.75 (e.g. Hercules AS-4), whereas the most commonly used pitch based carbon filaments, mesophase pitch based, have a specific gravity of 1.85 to 2.10.

In structural applications, there is an important relationship between the weight of the fiber and its strength. Carbon fibers are often used in place of glass fibers as reinforcement in order to save weight, for example in aircraft and space structure where weight is critical. In aircraft, carbon fiber is used for reinforcement of primary and secondary structures and interior parts such as flooring, luggage bins, ducting, etc. While conventional carbon fibers are very useful in the environments noted above and have an excellent strength to weight ratio, the need exists for fibrous reinforcing materials having an even better strength to weight ratio.

Carbon fibers are also used in a variety of miscellaneous environments such as for high temperature gaskets, seals, pump packing, medical implants, cement reinforcement, etc. Most fiber-reinforced plastics are laminated materials. The fibers in each layer are usually arranged in one of four configurations such as in the form of uni-directional tape, woven fabric, chopped and aligned fibers or randomly disposed fibers in the form of a mat or non-woven fabric.

Another problem with conventional carbon fibers is that they have a tendency to be non-circular, i.e. either during spinning of the precursor or transformation of the precursor fiber to carbon fiber, the cross-section tends to flatten or distort into a more or less dog-bone or kidney-shaped cross-section, and this problem especially occurs in the manufacture of conventional dry spun carbon precursors from PAN, and from rayon precursor. Carbon fibers which are somewhat flattened or kidney shaped in cross-section provide somewhat irregular and more difficult to control properties in the final article.

A further problem for the PAN precursor carbon fiber is that a shrinkage of approximately 40–50% occurs in converting the precursor into the carbon fiber. As a result, longitudinal surface cracks tend to occur which reduce the physical properties of the resultant carbon fiber.

In a conference held on Apr. 25, 1990, Dr. A. S. Abhiraman, Georgia Institute of Technology, made a presentation concerning the accidental production of carbon fibers with holes. A slide was shown of a cross-section of such a fiber, which cross-section was of a doughnut shape; on the other hand, these fibers were not characterized as being hollow fibers and the inference drawn from the materials presented suggested that the holes produced were non-continuous. Dr. Abhiraman indicated that these fibers were produced by accident by faster than normal rate of carbonization and indicated that he had found no uses for such carbon fibers with holes and that they are of no known value. The physical properties were not discussed and no conclusions can be drawn as to the brittleness, tensile strength and other properties of carbon fibers with holes as so produced by a faster than normal rate of carbonization.

Dr. Abhiraman and his colleagues have a number of publications. Grove et al, in *Carbon*, 26(3), 403–11 (Eng 1988) in an article entitled "Exploratory Experiments in the Conversion of Plasticized Melt Spun PAN-Based Precursors to Carbon Fibers" discusses exploratory experiments in the conversion of plasticized melt spun PAN-based precursors to carbon fibers wherein, in some cases (see the abstract), "the precursor fibers have broken filaments as well as surface defects and internal voids, all of which hinder the development of superior properties". In the concluding remarks at pages 410 and 411 it is indicated, "Microholes were observed frequently in SEM examination of cross-sections of . . . fibers, suggesting the presence of impurities in the precursor fibers. Surface flaws and impurities will have to be reduced for these melt spun, PAN-based precursor fibers to become a viable alternative to current wet or dry spun, acrylic precursors".

Balasubramanian et al (Bienn. Conf. Carbon, 17th, 312–13, Eng. 1985), in an article entitled "Evolution Structure and Properties in Continuous Carbon Fiber Formation" discusses certain PAN based carbon fibers, some of which are said to have hollow cores (see Table 2). Column 2 on page 312 indicates that a hollow core forms when the fibers are incompletely stabilized and that it is necessary to properly stabilize to avoid the formation of a hollow core in the carbon fibers, the formation of the hollow core being caused by burning-off of an incompletely stabilized core as well as the rapid development of a rigid skin. It appears quite clear that the formation of a hollow core is undesirable.

Abhiraman, in "From PAN-Based Precursor Polymers to Carbon Fibers: Evolution of Structure and Properties" appearing in Adb. Mater. Technol. '87, 945–52 [Eng] 1987) mentions the production of hollow core carbon fibers and indicates what parameters must be controlled "in order to avoid core blow-out in carbonization". Again, there appears to be no disclosure of carbon fibers which are continuously and generally uniformly hollow, no disclosure that any such carbon fiber might be useful, and no disclosure of the manufacture of a hollow carbon fiber from a hollow precursor.

Balasubramanian et al, in "Conversion of Acrylonitrile-Based Precursor Carbon Fibers—Part 3—Thermo-oxidative Stabilization and Continuous, Low Temperature Carbonization" appearing in Journal of Material Science 22 (1987) 3864–3872, mention hollow core carbon fibers. The following statement appears in the last paragraph on page 3866:

> One of the consequences of insufficient stabilization in a diffusion controlled stabilization process is the development of a hole in the center of such fibers during carbonization. The holes form as a result of the incompletely stabilized core of the precursor fibers being burned off during carbonization.

It is evident that the irregularities produced, including hollow core, are to be avoided. There is no indication of such fibers being useful, no indication of the production of hollow fibers which have a generally continuous and uniformly hollow core, and no disclosure of the manufacture of hollow carbon fibers from hollow precursor fibers.

In a "Materials and Processing Report" dated May, 1986 from Massachusetts Institute of Technology, Volume 1, No. 2, it is indicated that the researchers Dan Edie and Charles Fain of Clemson University found that they could increase the tensile strength of melt-spun pitch-based carbon fibers by modifying the flow profile during extrusion to form both non-circular and hollow fibers. In an undated report in the names of Harrison, Fain and Edie (Clemson University) entitled "Study of Hollow and C-Shaped Pitch-Based Carbon Fibers" it is seen that the hollow carbon fibers in question were of very large size, these having a typical outside diameter of 40–50 microns and a wall thickness of 8–15 microns providing a fiber cross-sectional area of up to $1000\mu^2$ in comparison with a typical 11.3 micron carbon fiber having a cross-sectional area of only $100\mu^2$ (page 79 of the undated report). Also see "Melt-Spun Non-Circular Carbon Fibers" by Edie, Fox, Barnett and Fain appearing in *Carbon,* Volume 24, No. 4, pp. 477–482 (1986).

SUMMARY OF THE INVENTION

It is, accordingly, an object of the present invention to overcome deficiencies of the prior art, such as those indicated above.

It is another object of the present invention to provide carbon filaments from a variety of sources including pitch, PAN, and rayon, which carbon filaments are uniform and have good strength and improved insulation properties.

It is a further object of the present invention to provide generally continuously and uniformly hollow carbon filaments having an equivalent or apparent specific gravity on the order of about 20–50% less than prior solid carbon filaments from the same precursor, starting with hollow filaments formed from precursor materials such as pitch, PAN, and rayon.

It is still a further object of the present invention to provide woven carbon fiber fabrics formed from carbon fibers which are hollow and have an equivalent or apparent specific gravity of about 20–50% less than prior carbon fibers from the same precursor.

It is yet a further object of the present invention to provide a variety of products such as insulation, brakes, passive fire protection panels, structural elements, gaskets, seals, pump packings, medical implants, cement reinforcement elements, etc. from hollow carbon fibers derived from pitch, PAN, rayon or the like, which products are substantially equal to or better with regard to their strength to weight ratio and their insulation properties compared to otherwise similar parts made from conventional carbon fiber derived from the same precursors.

These and other objects of the present invention will be more apparent from the following detailed description. In brief, however, the present invention involves the use of hollow monofilaments formed of PAN, pitch, rayon or other resinous precursor materials for the manufacture of generally continuously and uniformly hollow carbon fibers having a generally uniform and circular cross-section, good strength and improved insulation properties, as a replacement for the carbon fibers presently in use. The hollow carbon and/or graphite fibers so produced have excellent insulative properties, and a high bending strength to weight ratio. These hollow carbon fibers have an equivalent or apparent specific gravity of about 20–50% less than the conventional carbon and/or graphite fibers derived from the same precursor material. Additional aspects of the invention will become more apparent from the following detailed description, taken in conjunction with the drawing, wherein:

DETAILED DESCRIPTION OF EMBODIMENTS

Figure 1:
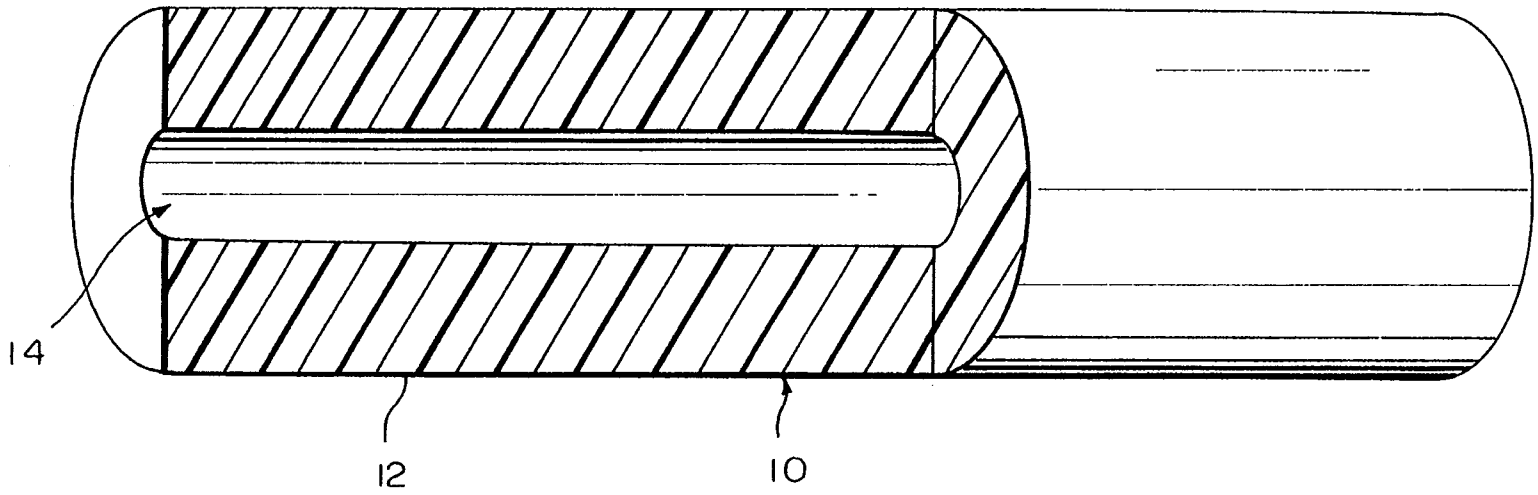
FIG. 1, the sole figure, is a greatly enlarged schematic illustration of both a resinous hollow precursor filament and the hollow carbon filament made therefrom.

FIG. 1 provides a schematic representation of a precursor fiber, such as one made from pitch, PAN or rayon, and the resultant carbon fiber formed therefrom in accordance with the present invention. The fiber or filament 10 is provided with a substantially non-porous annular body portion 12 surrounding a hollow bore 14. In one example, the outer diameter of the precursor filament 10 is 2 mils (0.002 inches) with the wall thickness of the body portion 12 being 0.45 mils. In such a case, the cross-sectional area of the body portion, exclusive of the hollow bore 14, is 65% of the cross-section of an otherwise similar precursor fiber but without the hollow bore 14, whereupon it is clear that the weight of the precursor filament 10, and consequently the weight of the final carbon fiber, formed from the same precursor material is approximately 35% less.

Whether these hollow carbon filaments are woven into fabric or are used in non-woven mat or other form, they are used as insulation material by impregnation thereof with a suitable matrix resin, such as phenolic resin, epoxy resin, urea or melamine resin, silicone rubber, polyester resin, polyimine, polybutadiene, vinyl ester polymers, and thermoplastics including polyetherketone (PEEK), polyetherimide (PEI) and polysulfone, to form any particular product. Improved insulation occurs because of the presence of the hollow bore 14.

Because of the hollow bore extending through the carbon filament 10, its equivalent or apparent specific gravity is relatively low, depending on the particular precursor material from which it is formed. Thus, using PAN as a precursor (e.g. Hercules AS-4 carbon filaments formed from PAN have a specific gravity of about 1.75), the otherwise similar carbon fibers 10 according to the present invention will have an equivalent or apparent specific gravity of about 0.88 to about 1.4. Those based on mesophase pitch (wherein the conventional mesophase pitch based carbon fibers have a specific gravity of 1.85 to 2.10) will have an equivalent or apparent specific gravity of about 0.93 to about 1.7.

As is conventional, carbon filaments 10 according to the present invention have a fiber diameter on the order of about 5–15 micrometers, usually 6–10 micrometers. The hollow carbon fibers 10 of the present invention, while not quite as strong in certain regards as those of the prior art having an equal outer diameter, are nevertheless almost as strong and have a higher ratio of strength to weight. In general, these fibers have a better section modulus and bending strength.

Suitable precursors include PAN, mesophase (liquid crystal) pitch, ordinary (non-mesophase) pitch, rayon, polyacetylene, poly (vinyl alcohol), polybenzimidazole, furan resins (mixed or reacted with phenolic resins or pitch), and novoloids (e.g. phenolic resin). These materials are initially thermoplastic and then go through a thermoset phase.

The hollow precursor fibers are made in the same way as hollow textile fibers and hollow bristles, using appropriately shaped spinnerette orifices. See the patents to Dietzsch et al U.S. Pat. No. 3,197,812; Heyhen et al U.S. Pat. No. 3,121,254; Hays U.S. Pat. No. 3,313,000; Long U.S. Pat. No. 3,605,162; Champaneria U.S. Pat. No. 3,745,061; Cox U.S. Pat. No. 4,020,229; Payne et al U.S. Pat. No. 4,279,053; Ward U.S. Pat. No. 4,307,478; Van Drunen et al U.S. Pat. No. 3,328,168; Mcintosh et al U.S. Pat. No. 3,465,618; Opfell U.S. Pat. No. 3,558,420; Shimoda U.S. Pat. No. 3,600,491; Turner U.S. Pat. No. 3,728,428; Tolliver U.S. Pat. No. 3,772,137; and Hodge U.S. Pat. No. 3,924,988, among others. However, deviating from normal practice, especially in the preparation of precursor fibers by dry spinning, it is preferred to feed a non reactive gas such as nitrogen to the center of the spinnerette orifice.

The precursor resin is for example melt spun in its thermoplastic state, or dry or wet spun, and the substantially non-porous hollow spun yarn is then thermoset to render the hollow polymer fibers infusible and capable of being carbonized. If the precursor is rayon, i.e. regenerated cellulose, the liquid is spun into the regeneration medium. The resultant hollow precursor fibers are then treated to form carbon fibers according to the conventional manufacturing processes for converting that particular precursor material into carbon. A suitable process is described below:

A mesophase pitch or PAN or rayon starting material together with, if desired, a solvent or plasticizer or other additive, is processed in an extruder or pump and then forced through a monofilament or multifilament die having tube forming orifice(s) at a temperature sufficient to form the hollow precursor filament 10. The optimum cross-sectional area of the hollow core is about 35% of the total cross-sectional area of the extruded filament, plus or minus 10%; if the area of the core is greater than about 50%, the strength of the final carbon fibers is insufficient for many purposes, and if the area of the hollow core is less than about 20%, the improvement achieved in insulation becomes minimal and the economics become questionable. Depending on the conditions, fiber size and material, hollow cores of as little as 40% may result in wall thicknesses not sufficiently great to retain cross-sectional uniformity.

The resultant hollow filament is quenched and oriented, and the resultant fiber may then be heat set which is typical of synthetic fiber production. The fiber is then carbonized and, if desired, graphitized according to conventional technology. Details concerning the extrusion temperatures and various post-treatments are available from the literature including the patent literature, as mentioned in parent application Ser. Nos. 07/476,050 and 07/534,075, and the prior patents mentioned therein, the contents of which are incorporated by reference.

EXAMPLES

A PAN dope was formed using PAN resin and DMAC. The dope preparation reservoir was mounted just before the spin pump. A wet spinning spin pump was used having a capacity of 0.16 cc/revolution. A 400 mesh filter pack was placed downstream of the spin pump. A single orifice die was located downstream of the filter pack. A pair of spaced take up rolls were provided downstream of the spinnerette. The spinnerette or die had an outer diameter of 40 mils for the orifice and an outer diameter of 20 mils for a gas injecting needle placed at the center of the orifice through which nitrogen was passed at a pressure of about 1 inch of water. The spin dope had a viscosity of 2000 poise. A water quench bath was provided one-half inch below the spinnerette orifice.

In one example, the pump speed was 40 seconds per revolution, the die temperature was 30° C., the first roll was rotated at 12 feet/minute and the second roll was rotated at 132 feet/minute. The apparent specific gravity of the resultant fiber was 0.753 which is very close to the theoretical value of 0.72 based on the hollow fiber wall area thereby showing that the annular fiber wall was substantially non-porous, and the cross-sectional area of the hollow core was 35%.

In another example using the same equipment and the same PAN dope, fibers were produced with a hollow core constituting 40% of the cross-sectional area of the precursor PAN fibers. In this case the uniformity of the fibers was not as good as in the preceding example, i.e. some of the fibers became oval in cross-section or partly flattened.

The hollow carbon fibers 10 produced according to the present invention have a slightly lower strength than conventional carbon fibers formed of the same precursor material, but they are nevertheless found to have a surprisingly high strength to weight ratio and superior bending strength. In other words, their strength is reduced to a lesser degree than is their equivalent or apparent specific gravity. In addition, the hollow carbon fibers 10 have exceptional insulating properties. Consequently, they are useful in a wide variety of environments, and can be used as a replacement for asbestos and conventional carbon fibers in many applications including furnace insulation, brakes, passive fire protection, and other thermal insulator environments. Because of its lower thermal conductivity across its cross-section, the hollow carbon fiber of the present invention is advantageous compared to the conventional fiber for most of these uses. For example, for use as furnace insulation comparable heat transfer results are obtained with less insulation thickness when the hollow fiber of the present invention is employed in place of the conventional carbon fiber.

The same is true in the construction of aircraft brakes using a carbon-carbon structure employing carbon reinforcing fibers and a carbon matrix. To obtain the same equilibrium temperature value, the brake pads using hollow carbon fibers according to the present invention can be made correspondingly thinner which provides a first saving in weight. Because the hollow carbon fibers of the present invention are lighter in weight than conventional carbon fibers, this itself provides a second savings in weight, so that the total savings in weight is significant.

Hollow carbon fibers according to the present invention are also useful for structural applications, especially for aircraft and space structures where weight is critical. Although the bending strength of any particular hollow carbon fiber is slightly lower than the strength of a conventional carbon fiber of equal diameter, the bending strength to weight ratio is higher. In many commercial aircraft applications where strength is not a major factor such as luggage bins, ducting, etc. carbon fiber is used in place of glass fiber in order to save weight. Use of the hollow carbon fiber of the present invention provides an added increase in weight reduction.

Carbon fiber is also used in a variety of environments such as high temperature gaskets, seals, pump packing, medical implants, cement reinforcement, etc. in place of asbestos and other reinforcing materials. The hollow carbon fibers of the present invention are very useful in these miscellaneous environments and provide excellent adhesion to a wide variety of matrix materials.

The hollow fibers so formed in accordance with the present invention can also be used as formed, i.e. without converting them to carbon fibers, for a variety of purposes, including textile uses, as these fibers are excellent insulators and are strong and lightweight.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. An improved carbon reinforcement and insulation fiber formed from a hollow precursor fiber, said carbon fiber having a round cross-section and being hollow by the provision of a continuous hollow bore therethrough, said hollow carbon fiber having an equivalent or apparent specific gravity approximately 20–50% less than a solid carbon fiber of the said size formed of the same precursor material, the wall of said fiber being substantially non-porous.

2. A hollow carbon fiber according to claim 1 wherein said precursor is pitch.

3. A hollow carbon fiber according to claim 2 wherein said pitch is mesophase pitch.

4. A hollow carbon fiber according to claim 3 having an equivalent or apparent specific gravity of about 0.93 to 1.7.

5. A hollow carbon fiber according to claim 1 wherein said precursor fiber is rayon.

6. A hollow carbon fiber according to claim 1 wherein said precursor is PAN.

7. A hollow carbon fiber according to claim 6 having an equivalent or apparent specific gravity of about 0.88 to 1.4.

8. A hollow carbon fiber according to claim 1 wherein said hollow precursor fiber is spun while injecting a stream of gas at the center thereof to form said continuous hollow bore.

9. An improved insulation and reinforcement carbon fiber formed from a hollow resinous precursor fiber, said carbon fiber being substantially non-porous and having a generally consistent circular cross-section and being hollow by the provision of a continuous bore therethrough from end to end, said fiber being generally continuously and uniformly hollow along its length, the cross-sectional area of said hollow bore being approximately 35%, plus or minus 10%, of the cross-section of said carbon fibers, wherein said hollow precursor fiber is spun while injecting a stream of gas at the center thereof to form said continuous hollow bore.

10. In a reinforcing fabric formed of carbon fibers, the improvement wherein said carbon fibers are hollow carbon fibers according to claim 1.

11. In a reinforcing fabric formed of carbon fibers, the improvement wherein said carbon fibers are hollow carbon fibers according to claim 8.

12. In a reinforcing fabric formed of carbon fibers, the improvement wherein said carbon fibers are hollow carbon fibers according to claim 9.

13. In a composite material formed of a matrix material reinforced with carbon fibers, the improvement wherein said carbon fibers are hollow carbon fibers according to claim 1.

14. In a composite material formed of a matrix material reinforced with carbon fibers, the improvement wherein said carbon fibers are hollow carbon fibers according to claim 8.

15. In a composite material formed of a matrix material reinforced with carbon fibers, the improvement wherein said carbon fibers are hollow carbon fibers according to claim 9.

16. A hollow carbon fiber according to claim 1, formed from a precursor filament having an outer diameter on the order of 2 mils.

17. A hollow carbon fiber according to claim 9, formed from a precursor filament having an outer diameter on the order of 2 mils.

18. A hollow carbon fiber according to claim 9, wherein said precursor is PAN.

19. A hollow carbon fiber according to claim 1, wherein the cross-sectional area of said hollow bore is approximately 35%, plus or minus 10%, of the cross-section of said carbon fiber.

* * * * *